US006898998B2

(12) United States Patent
Shyu

(10) Patent No.: US 6,898,998 B2
(45) Date of Patent: May 31, 2005

(54) T-HANDLE RATCHET WRENCH

(76) Inventor: Wen-Tsai Shyu, 8F., No. 68, Yu-Shyan Rd., Taiping (TW), 411

( * ) Notice: Subject to any disclaimer, the term of this patent is extended or adjusted under 35 U.S.C. 154(b) by 0 days.

(21) Appl. No.: 10/666,785

(22) Filed: Sep. 22, 2003

(65) Prior Publication Data

US 2004/0103764 A1 Jun. 3, 2004

Related U.S. Application Data

(63) Continuation-in-part of application No. 10/305,321, filed on Nov. 29, 2002, now abandoned.

(51) Int. Cl.[7] ..... B25B 13/46

(52) U.S. Cl. ..... 81/63.1; 81/177.6; 81/177.7; 81/124.7; 81/177.2

(58) Field of Search ..... 81/177.5–177.9, 81/60, 61, 63.1, 124.7, 124.3, 58.1, 58.4, 177.1, 177.2

(56) References Cited

U.S. PATENT DOCUMENTS 5,797,300 A * 8/1998 Fairbanks ..... 81/60

* cited by examiner

*Primary Examiner*—Debra S. Meislin
(74) *Attorney, Agent, or Firm*—Troxell Law Office, PLLC

(57) ABSTRACT

The invention relates to a T-handle ratchet wrench including a lateral bar and a ratchet set. The lateral bar has a hollow connection part located in the center of the lateral bar and used for installing the ratchet set. Two flanks of the lateral bar make up a handgrip, respectively. The top of ratchet set is provided with a rotation button while a vertical bar extends downwardly from the rotation button. At least one of the handgrips includes a pivotal ear with a through hole, and the pivotal ear can be fitted into an insertion slot with a through hole at the free end of the lateral bar. A pivotal pin then passes through the through hole in the pivotal ear and the through hole in the insertion slot. This permits a pivotal movement of the handgrip on the pivotal pin. Accordingly, this configuration will considerably minimize the occupied space in packing, transport, storage and carrying. Particularly, the operators can more easily apply his force on the driver under special operation environments.

1 Claim, 3 Drawing Sheets

T-HANDLE RATCHET WRENCH

This invention is a continuation-in-part of U.S. patent application Ser. No. 10/305,321 filed Nov. 29, 2002, now abandoned.

BACKGROUND OF THE INVENTION

1. Fields of the Invention

The invention relates to a T-handle ratchet wrench, and more particularly, to a wrench having a swivel handgrip. By use of at least one handgrip, this configuration will considerably minimize the occupied space in packing, transport, storage and carrying. Particularly, the operators can more easily apply his force on the driver under special operation environments.

2. Description of the Related Art

In light of U.S. patent application Ser. No. 10/305,321, filed by the inventor of the invention, that teaches a fixed type T-handle ratchet wrench, large space in packing, transport, storage and carrying must be consumed and occupied. Therefore, more cost is necessary. Meanwhile, it's not easy to be carried. Moreover, the shape is fixed and is not changeable. In addition, it's unusable in special operation environments (e.g. in a narrow position and in a narrow gap), thereby making it both uneconomical and impractical.

SUMMARY OF THE INVENTION

Therefore, it is a primary object of the invention to eliminate the above-mentioned drawbacks and to provide a T-handle ratchet wrench whose use value is much more raised than the previous application Ser. No. 10/305,321.

It's preferable that at least one of the handgrips includes a pivotal ear with a through hole, and the pivotal ear can be fitted into an insertion slot with a through hole at the free end of the lateral bar. A pivotal pin passes through the through hole in the pivotal ear and the through hole in the insertion slot. This permits a pivotal movement of the handgrip on the pivotal pin. Accordingly, this configuration will considerably minimize the occupied space in packing, transport, storage and carrying. Particularly, the operators can more easily apply his force on the driver under special operation environments.

BRIEF DESCRIPTION OF THE DRAWINGS

The accomplishment of this and other objects of the invention will become apparent from the following description and its accompanying drawings of which.

DETAILED DESCRIPTION OF THE PREFERRED EMBODIMENT

Figure 1:
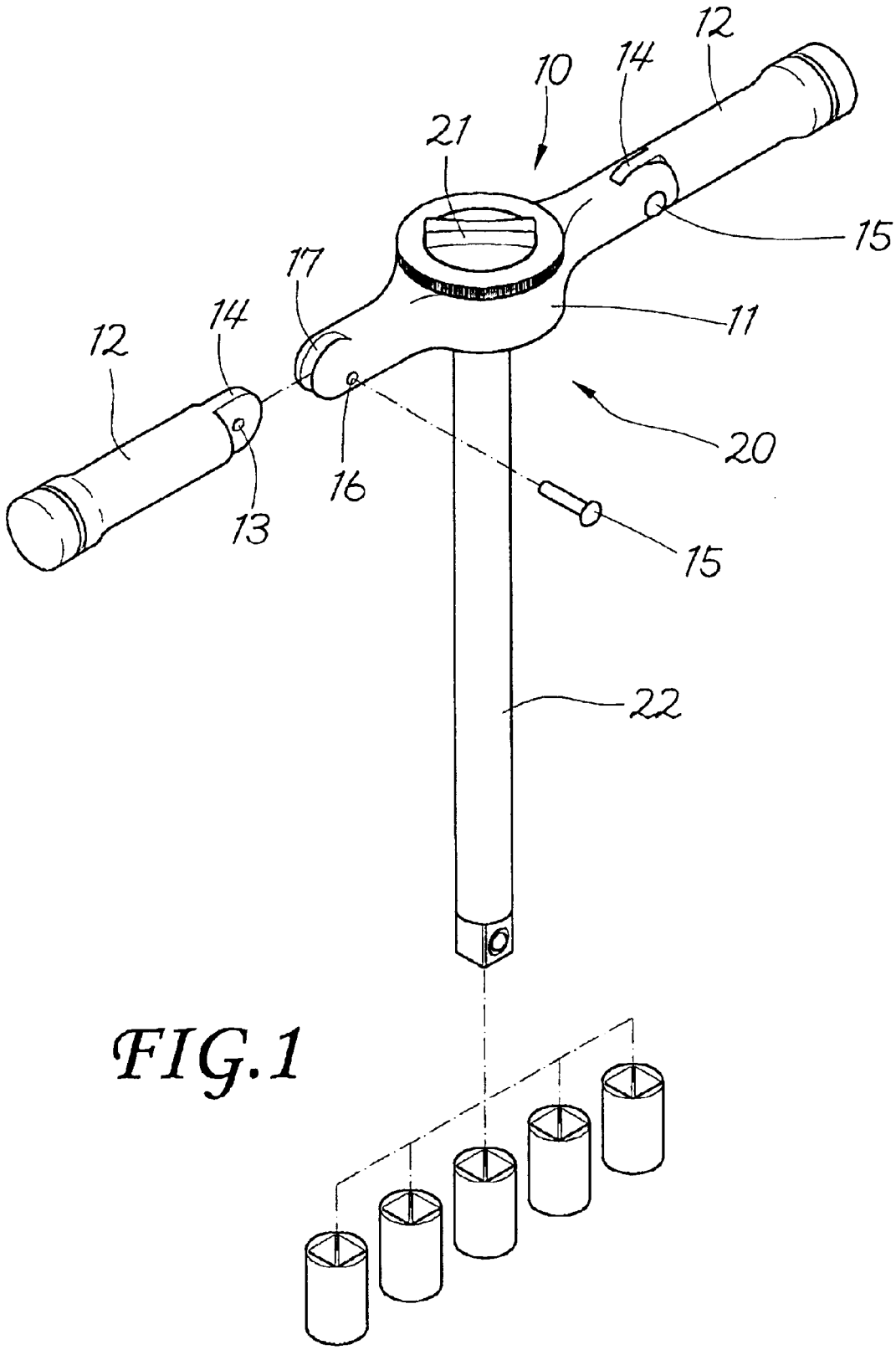
FIG. 1 is a partially exploded view of a preferred embodiment of a T-handle ratchet wrench in accordance with the invention.
Figure 2:
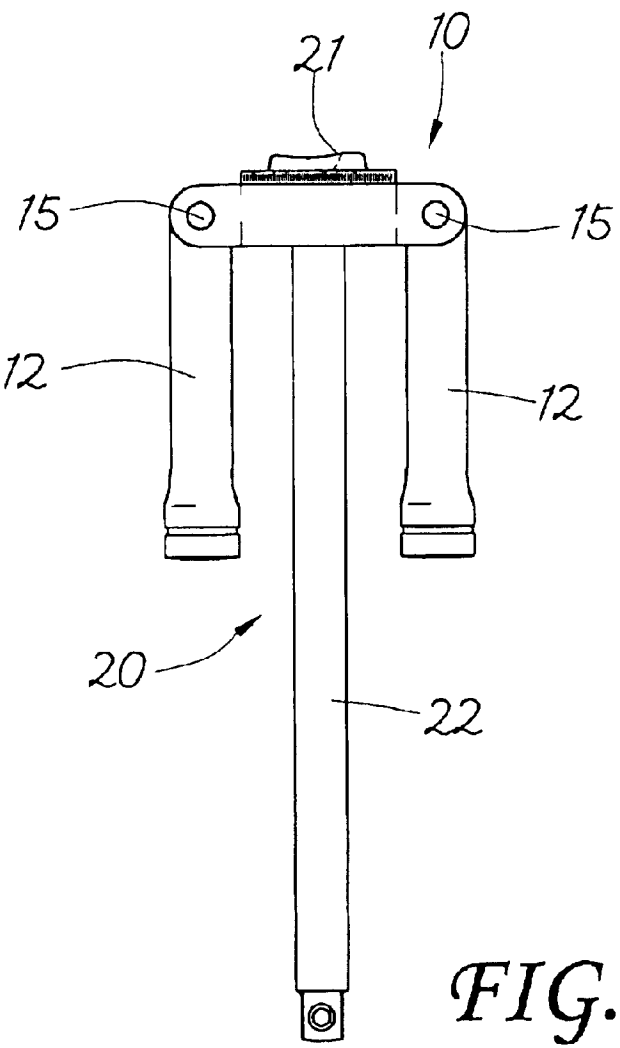
FIG. 2 is a front view of FIG. 1 showing both handgrips are bent down.
Figure 4:
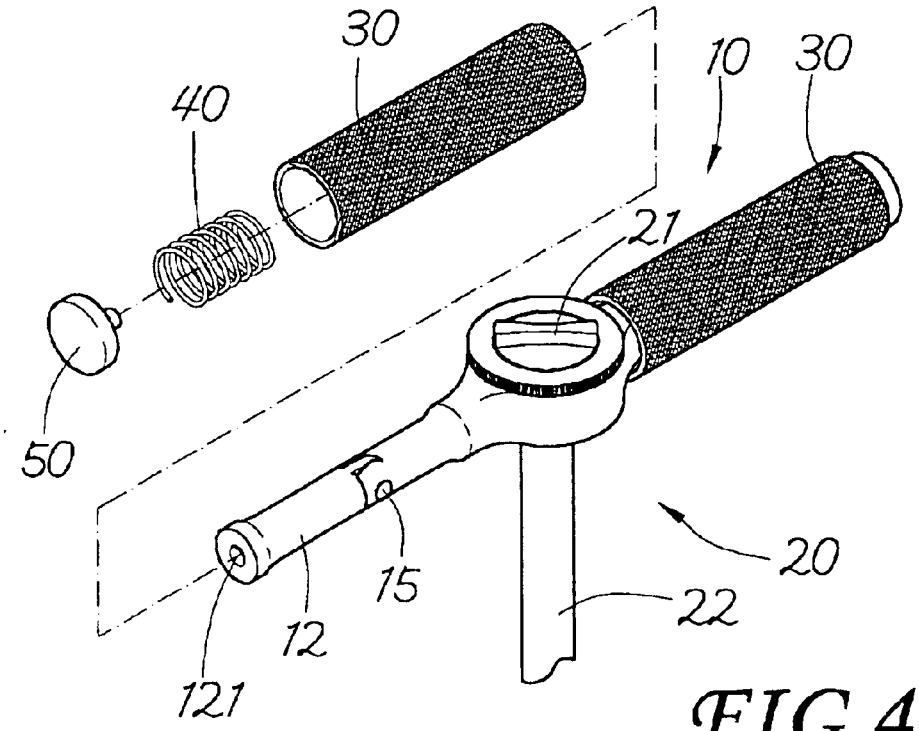
FIG. 4 is a partially exploded view of a further embodiment of the invention.

First of all, as shown in FIGS. 1 and 2, the invention includes a lateral bar 10 and a ratchet set 20. The lateral bar 10 has a hollow connection part 11 located in the center of the lateral bar 10 and used for installing the ratchet set 20. Two flanks of the lateral bar 10 make up a handgrip 12, respectively. The top of ratchet set 20 is provided with a rotation button 21 while a vertical bar 22 extends downwardly from the rotation button 21. At least one of the handgrips 12 includes a pivotal ear 14 with a through hole 13, and the pivotal ear 14 can be fitted into an insertion slot 17 with a through hole 16 at the free end of the lateral bar 10. A pivotal pin 15 then passes through the through hole 13 in the pivotal ear 14 and the through hole 16 in the insertion slot 17. This permits a pivotal movement of the handgrip 12 on the pivotal pin 15. Accordingly, this configuration will considerably minimize the occupied space in packing, transport, storage and carrying. Particularly, the operators can more easily apply his force on the driver under special operation environments.

Figure 3:
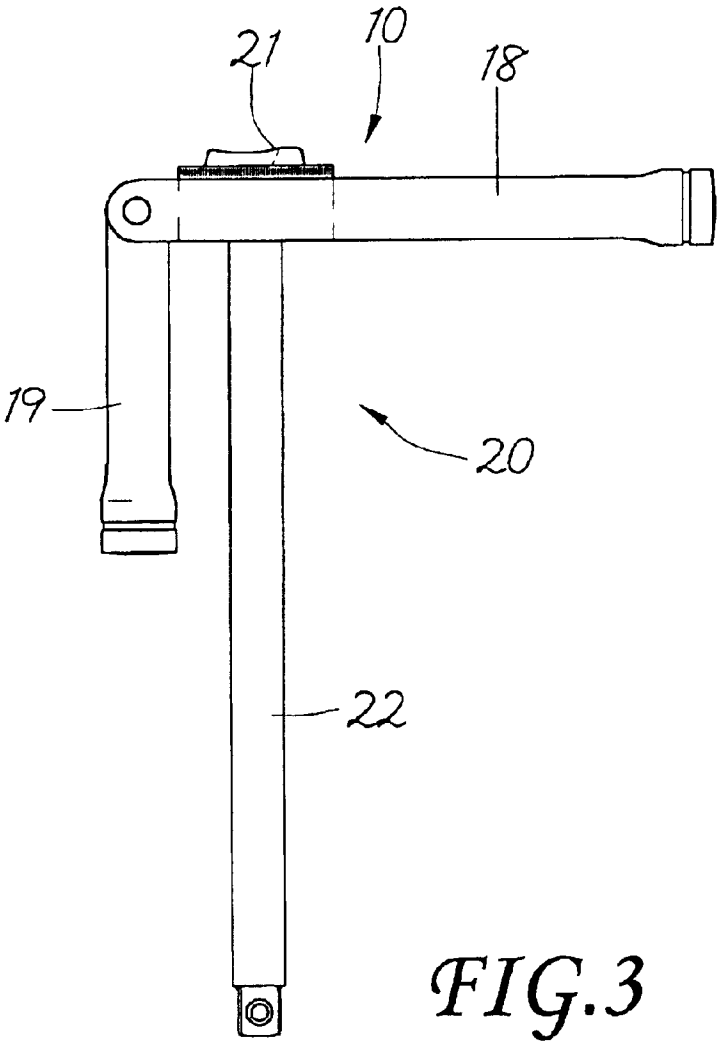
FIG. 3 is a front view of another embodiment of the invention showing only one handgrip is bend down.

Alternatively, as shown in FIG. 3, one end of the lateral bar 10 of the invention is constructed as a fixed type handgrip 18 while the other end thereof is constructed as a swiveled type handgrip 19. This modified embodiment of the invention can reach the expected effect as well.

In order to improve the insufficient torque resistance due to the pivotal configuration between the lateral bar 10 and the handgrip 12, a sleeve 30 can be mounted on the handgrip 12. Moreover, a spring 40 is placed into the sleeve 30. Meanwhile, the free end of the handgrip 12 includes an insertion hole 121 into which a positioning plug 50 is fitted. The internal wall of the sleeve 30 is provided with a blocking ring 31 so that the spring 40 is located between the blocking ring 31 and the positioning plug 50. This permits a correct positioning of other components. Besides, the length of the sleeve 30 is so configured that the sleeve 30 can cover the pivotal part between the lateral bar 10 and the handgrip 12, thereby increasing the torque resistance in the pivotal position.

Figure 5:
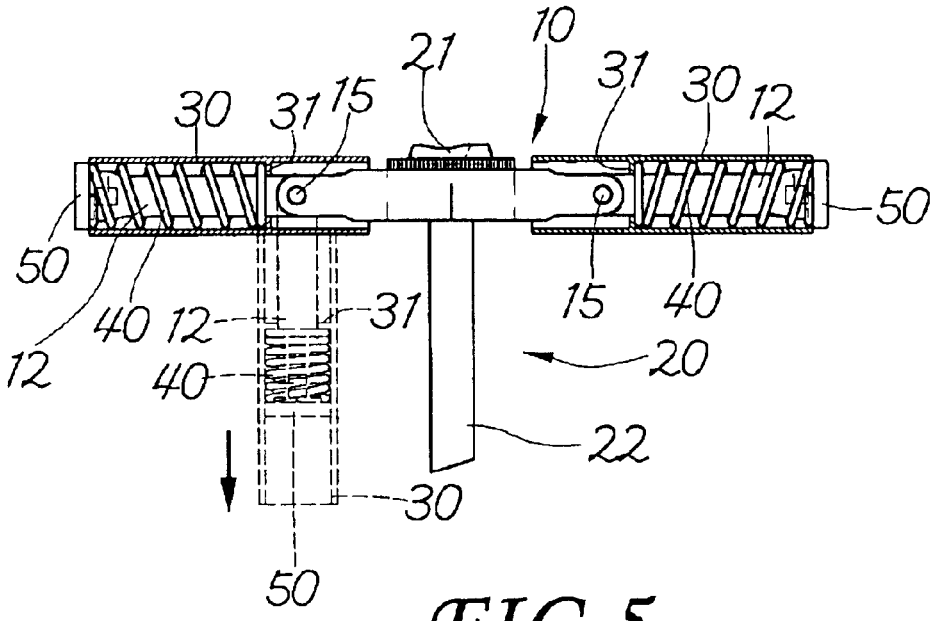
FIG. 5 is a sectional view of FIG. 4 with dashed line showing the bent-down handgrip.

Further, referring to FIG. 5, when the operator wants to bend down the handgrip 12, it's only required to pull the sleeve 30 outwardly until the pivotal part is exposed to the outside. At that time, the spring 40 is in a compressed state. To the contrary, the operator can conveniently fold up the handgrip 12 under influence of the restoring force of the spring 40.

Many changes and modifications in the above-described embodiments of the invention can, of course, be carried out without departing from the scope thereof. Accordingly, to promote the progress in science and the useful arts, the invention is disclosed and is intended to be limited only by the scope of the appended claims.

What is claimed is:

1. A T-handle ratchet wrench comprising:

a) a lateral bar having a hollow connection part located in the center of the lateral bar and used for installing a ratchet set;

b) the ratchet set having a rotation button at the top thereof while a vertical bar extends downwardly from the rotation button;

c) at least one handgrip pivotally connected to the lateral bar and having a pivotal ear with a through hole, the pivotal ear being fitted into an insertion slot with a through hole at the free end of the lateral bar, a pivotal pin passes through the through hole in the pivotal ear and the through hole in the insertion slot, and this permits a pivotal movement of the handgrip on the pivotal pin within the lateral bar; and d) a sleeve that is mounted on the handgrip while a spring is placed into the sleeve wherein the free end of the handgrip includes an insertion hole into which a positioning plug is fitted, and the internal wall of the sleeve is provided with a blocking ring so that the spring is located between the blocking ring and the positioning plug, wherein a length of the sleeve covers a pivotal part between the lateral bar and the handgrip.

* * * * *